US008205538B2

(12) United States Patent
Dueck et al.

(10) Patent No.: US 8,205,538 B2
(45) **Date of Patent: *Jun. 26, 2012**

(54) MUZZLE BRAKE SYSTEMS AND METHODS

(75) Inventors: Barry W. Dueck, Sunset Beach, CA (US); Michael Voigt, Chino, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/098,131

(22) Filed: Apr. 29, 2011

(65) Prior Publication Data

US 2011/0203447 A1 Aug. 25, 2011

Related U.S. Application Data

(63) Continuation of application No. 11/543,392, filed on Oct. 4, 2006, now Pat. No. 7,954,414.

(51) Int. Cl.
*F41A 21/00* (2006.01)

(52) U.S. Cl. ..... 89/14.3

(58) Field of Classification Search ..... 42/79; 89/14.05, 89/14.1, 14.2, 14.3, 14.4, 14.5
See application file for complete search history.

(56) References Cited

U.S. PATENT DOCUMENTS

| | | | | |
|---|---|---|---|---|
| 2,348,114 | A | 5/1944 | Dow | |
| 2,809,560 | A | 10/1957 | Matson et al. | |
| 3,115,060 | A | 12/1963 | Ashbrook et al. | |
| 3,177,771 | A | 4/1965 | McKim | |
| 3,676,947 | A * | 7/1972 | Ashbrook et al. | 42/79 |
| 3,710,683 | A | 1/1973 | Kaltmann | |
| 3,714,864 | A | 2/1973 | Thierry | |
| 4,643,073 | A | 2/1987 | Johnson | |
| 4,691,614 | A | 9/1987 | Leffel et al. | |
| 4,879,942 | A | 11/1989 | Cave | |
| 5,020,416 | A | 6/1991 | Tripp | |
| 5,063,827 | A | 11/1991 | Williamson | |
| 5,092,223 | A | 3/1992 | Hudson | |
| 5,385,079 | A | 1/1995 | Cave | |
| 5,476,028 | A | 12/1995 | Seberger | |
| 5,811,714 | A | 9/1998 | Hull et al. | |
| 5,914,757 | A | 6/1999 | Dean et al. | |
| 6,216,578 | B1 | 4/2001 | Ledys et al. | |
| 6,276,251 | B1 | 8/2001 | Downing et al. | |
| 6,578,462 | B1 | 6/2003 | Franchino et al. | |
| 6,722,254 | B1 | 4/2004 | Davies | |
| 6,752,062 | B2 | 6/2004 | Vais | |
| 6,820,530 | B2 | 11/2004 | Vais | |
| 7,032,339 | B1 | 4/2006 | Bounds | |
| 7,328,645 | B1 | 2/2008 | Curry et al. | |
| 2003/0106417 | A1 * | 6/2003 | Vais | 89/14.3 |

OTHER PUBLICATIONS

JP Enterprises, Inc., "Bennie Coolie Recoil Eliminator" (prior to Sep. 2005), http://www.iprifles.com/BennieCooleyeliminator.php, 1 page.

OPS, Inc., "R3E2C Muzzle Brake" (prior to Sep. 2005), http://opsinc.us/brake,php, 1 page.

* cited by examiner

*Primary Examiner* — Gabriel Klein
(74) *Attorney, Agent, or Firm* — Haynes and Boone, LLP

(57) ABSTRACT

A muzzle brake for a firearm, in accordance with one or more embodiments, may provide structural features that affect the flow characteristics of the combustion gases for reducing concussion to the shooter and/or to personnel to the sides of the shooter, as well as for directionally countering upward and sideward movement of the firearm's muzzle upon the firing of the firearm.

15 Claims, 2 Drawing Sheets

MUZZLE BRAKE SYSTEMS AND METHODS

CROSS-REFERENCE TO RELATED APPLICATIONS

This patent application is a continuation of U.S. patent application Ser. No. 11/543,392 filed Oct. 4, 2006, which is incorporated herein by reference in its entirety.

TECHNICAL FIELD

One or more embodiments of the invention relate to muzzle brakes for firearms, and more particularly to a muzzle brake, which for example may provide improved combat effectiveness.

BACKGROUND

Muzzle brakes for firearms typically include various baffles, ports and vents to reduce recoil and muzzle rise when firing the firearm. Many such muzzle brakes, when used in a combat situation, tend to direct concussion from combustion gases back to the shooter and personnel to the side of the shooter at a level that detracts from combat effectiveness. Further, it does not appear that these and other known muzzle brakes have effectively compensated for muzzle rise (i.e. upward movement of the muzzle) or sideward movement of the muzzle upon firing of the firearm, particularly as concerning sideward movement to the right for a right-hand shooter and to the left for a left-hand shooter.

SUMMARY

The muzzle brake for one or more embodiments of the present invention includes structural features that affect the flow characteristics of the combustion gases, for reducing concussion to the shooter and to personnel to the sides of the shooter, as well as for directionally countering upward and sideward movement of the firearm's muzzle upon the firing of the firearm.

According to an aspect of an embodiment of the present invention, there is provided a device including a body having an axial passageway configured to align with a firearm barrel as a muzzle brake; a first chamber of the body, the first chamber extending along the axial passageway and configured to receive combustion gases from the firearm barrel; and a second chamber of the body, the second chamber extending along the axial passageway and configured to receive at least a portion of the combustion gases from the first chamber, wherein the second chamber includes a front wall, a rear wall, a floor, and a ceiling, and wherein the floor, the ceiling, or both the floor and the ceiling have surfaces curved toward the axial passageway to form a corresponding longitudinally extending apex or nadir substantially parallel to the axial passageway. The device may further include a firearm having the firearm barrel, the body coupled to the firearm barrel such that a bullet passes through the firearm barrel and through the axial passageway, including the first chamber and the second chamber, before exiting out an exit bore of the body.

According to an aspect of an embodiment of the present invention, there is provided a device including a muzzle brake, having a body and an axial passageway, configured to couple to a muzzle of a firearm, the muzzle brake including a first chamber, disposed within the body and along the axial passageway, configured to receive combustion gases from the muzzle, the first chamber including at least one port configured to vent a first portion of the combustion gases; and a second chamber, disposed within the body and along the axial passageway, configured to receive at least a second portion of the combustion gases from the first chamber, wherein the second chamber includes a front wall, a rear wall, a floor, and a ceiling, and wherein the floor and/or the ceiling have gas diverting surfaces curved toward the axial passageway to form a corresponding longitudinally extending apex or nadir.

According to an aspect of an embodiment of the present invention, there is provided a method including aligning the body of the muzzle brake to the firearm barrel of a firearm; and coupling the body to the firearm barrel, wherein the surfaces form gas diverting surfaces for combustion gases in the event that the firearm is fired.

According to one aspect of an embodiment of the present invention, there is provided a muzzle brake for a firearm having a barrel with a muzzle extending along a longitudinal axis, the muzzle brake comprising: a generally cylindrical body adapted for attachment to the muzzle, the body including an axial passageway forwardly of and communicating with the muzzle when attached thereto; a high pressure first chamber in the body extending along the axial passageway for receiving combustion gases from the muzzle resulting from firing of the firearm; and a second chamber in the body extending along the axial passageway forwardly of the first chamber for receiving gases from the first chamber, the second chamber including a rear wall and a forward wall for deflecting gases in the second chamber, the second chamber including two opposing side openings in the body between the rear wall and the forward wall for laterally venting gases from the second chamber, the forward wall configured along the side openings for eliminating rearward deflection from the forward wall of a portion of the gases in the second chamber. The forward wall is preferably truncated along the second chamber's side openings for effecting such forward wall configuration.

One or more embodiments of the muzzle brake further includes: a third chamber in the body extending along the axial passageway forwardly of the second chamber for receiving gases from the second chamber, the third chamber including a forward wall for deflecting gases in the third chamber, the third chamber including two opposing side openings in the body between the second chamber's forward wall and the third chamber's forward wall for laterally venting gases from the third chamber, the third chamber's forward wall configured along the third chamber's side openings for eliminating rearward deflection of a portion of the gases in the third chamber. The forward wall of the third chamber is preferably truncated along the third chamber's side openings for effecting such forward wall configuration.

According to another aspect for one or more embodiments of the present invention, the muzzle brake's high pressure first chamber includes at least one port for venting a portion of the gases in the first chamber to directionally counter upward and sideward movement of the muzzle when the firearm is fired. The at least one port preferably transversely extends along opposite sides of the top of the muzzle brake body with the center of such at least one port being transversely offset from the top of the muzzle brake's body. A first port may be offset from and to one side of the top of the body, and a second port offset from and to the opposite side of the top of the body by a transverse distance greater than the transverse distance by which the first port is offset. Alternatively, a single port (e.g. a slotted port) may transversely extend along both sides of the top of the muzzle brake's body, with the center of the port being transversely offset from the top of the muzzle brake's body.

According to a further aspect for one or more embodiments of the muzzle brake of the present invention, the second chamber (and/or the third chamber) may include at least one gas diverting surface between its rear wall and its forward wall, and the at least one gas diverting surface may longitudinally divide the chamber. In this respect, the second chamber (and/or the third chamber) may include a floor between the rear wall and the forward wall, the floor being upwardly curved toward the axial passageway. The chamber may further include a ceiling between the rear wall and the forward wall, the ceiling being downwardly curved toward the axial passageway.

According to a further aspect for one or more embodiments of the present invention, there is provided a muzzle brake for a firearm having a barrel with a muzzle extending along a longitudinal axis, the muzzle brake comprising: a body adapted for attachment to the muzzle, the body including an axial passageway forwardly of and communicating with the muzzle when attached thereto; a high pressure chamber in the body extending along the axial passageway for receiving combustion gases from the muzzle resulting from firing of the firearm, the high pressure chamber including at least one port for venting a portion of the gases in the high pressure chamber to directionally counter upward and sideward movement of the muzzle when the firearm is fired; and a second chamber in the body extending along the axial passageway forwardly of the first chamber for receiving gases from the high pressure chamber, the second chamber including a forward wall upon which gases in the second chamber may impinge.

According to yet another aspect for one or more embodiments of the present invention, there is provided a muzzle brake for a firearm having a barrel with a muzzle extending along a longitudinal axis, the muzzle brake comprising: a body adapted for attachment to the muzzle, the body including an axial passageway forwardly of and communicating with the muzzle when attached thereto; and a chamber in the body extending along the axial passageway for receiving combustion gases from the muzzle resulting from firing of the firearm, the chamber including a forward wall for deflecting gases in the chamber, the chamber including two opposing side openings in the body and at least one gas diverting surface between the two opposing side openings. The at least one gas diverting surface preferably longitudinally divides the chamber, and may include a floor upwardly curved toward the axial passageway, and may further include a ceiling downwardly curved toward the axial passageway.

BRIEF DESCRIPTION OF THE DRAWINGS

The novel features believed to be characteristic of embodiments of the invention, together with further advantages thereof, will be better understood from the following description considered in connection with the accompanying drawings in which embodiments of the invention are illustrated by way of example. It is to be expressly understood, however, that the drawings are for the purpose of illustration and description only and are not intended as a definition of the limits of the invention.

DETAILED DESCRIPTION

Figure 6:
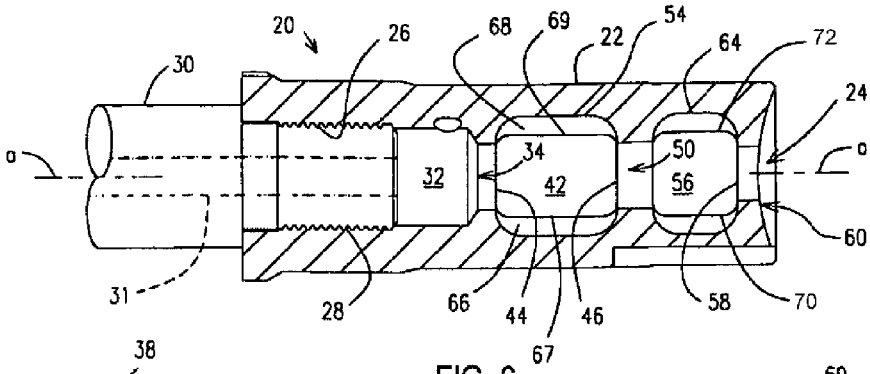
FIG. 6 is a longitudinal cross-sectional view of the muzzle brake of FIG. 1 according to an embodiment of the present invention, taken along the line 6-6 of FIG. 3 and viewed in the direction of the appended arrows, the muzzle brake shown in FIG. 6 as being attached to the muzzle of a firearm barrel according to an embodiment of the present invention.
Figure 7:
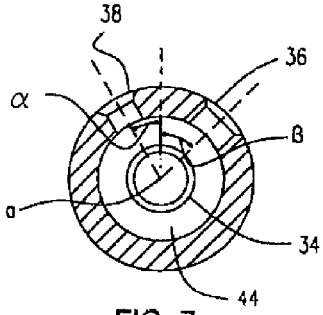
FIG. 7 is a cross-sectional view of the muzzle brake of FIG. 4 according to an embodiment of the present invention, taken along the line 7-7 and viewed in the direction of the appended arrows.
Figure 8:
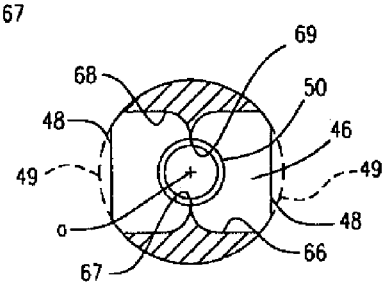
FIG. 8 is a cross-sectional view of the muzzle brake of FIG. 1 according to an embodiment of the present invention, taken along the line 8-8 of FIG. 1 and viewed in the direction of the appended arrows.
Figure 9:
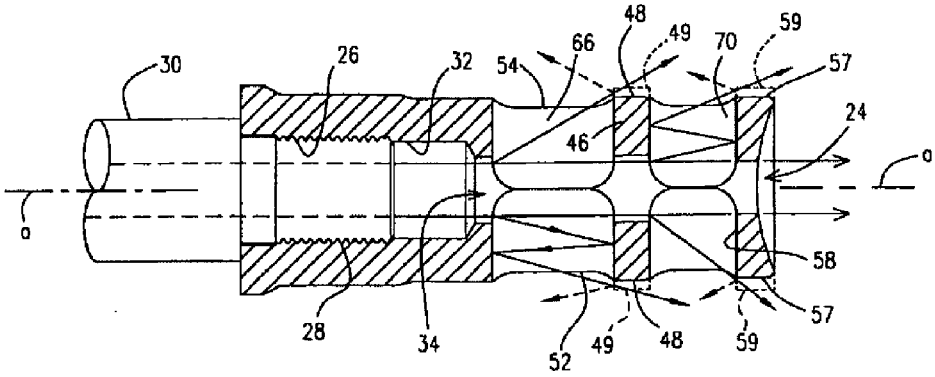
FIG. 9 is a longitudinal cross-sectional view of the muzzle brake of FIG. 1 according to an embodiment of the present invention, taken along the line 9-9 of FIG. 3 and viewed in the direction of the appended arrows, the muzzle brake shown in FIG. 9 as being attached to the muzzle of a firearm barrel and indicating a representation of gas flow modification resulting from an aspect of one or more embodiments of the present invention.

Turning to the drawings, there is illustrated in FIGS. 1-9 one or more embodiments of a muzzle brake 20 comprising a generally cylindrical body 22 having an axial passageway 24 forwardly of and communicating with a threaded bore 26 for threadedly securing the muzzle brake 20 to the threaded muzzle 28 of a firearm barrel 30 (see, in particular FIGS. 6 and 9). When the firearm is fired by a shooter, a bullet travels along the longitudinal bore 31 of the barrel 30, along the axial passageway 24 of the secured muzzle brake 20, and exits through an exit bore 60 at the muzzle brake's front end.

As used herein, the word "front" or "forward" corresponds to the firing direction of the firearm represented by the firearm barrel 30 (i.e., to the right as shown in FIGS. 1, 4-6, 9 and 10); "rear" or "rearward" corresponds generally to the direction opposite the front or forward direction; "longitudinal" means the direction along or parallel to the longitudinal axis a of the muzzle brake 20, or to the longitudinal axis a' of the firearm barrel 30; and "axial" means along the longitudinal axis a or a'.

The axial passageway 24 extends along the muzzle brake's longitudinal axis a and includes a first chamber 32 forwardly of the threaded bore 26 and adjacent to the barrel's muzzle 28 when the muzzle brake 20 is attached to the muzzle 28. The chamber 32 receives the combustion gases from the muzzle 28 resulting from a firing of a bullet from the firearm, and may be referred to as a pressure or high pressure chamber. The high pressure chamber 32 communicates with the muzzle brake's forward portion through an axial bore 34 of diameter preferably smaller than the diameter of the pressure chamber 32 but sufficiently large to permit passage therethrough of the fired bullet.

The pressure chamber 32 preferably includes at least one directional port for venting a portion of the high pressure combustion gases in such manner as to directionally counter upward and sideward movement of the firearm muzzle 28 when the firearm is fired. The one or more ports are arranged such that they transversely extend along both sides of the top (represented by the longitudinal crest line 35) of the body 22 with their effective center transversely offset from the top 35 of the body 22, i.e. the effective center of the one or more ports is transversely offset from a twelve o'clock or top dead center of the muzzle brake body 22 when the firearm with attached muzzle brake 20 is held in a firing position with the barrel 30 horizontally extended.

Figure 1:
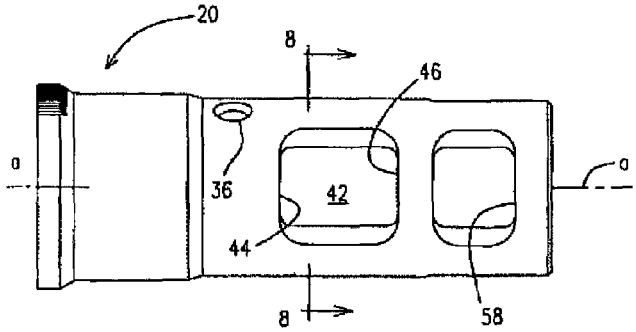
FIG. 1 is a side view of an embodiment of a muzzle brake for a firearm according to one or more embodiments of the present invention.
Figure 2:
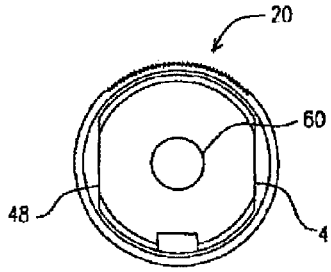
FIG. 2 is a front end view of the muzzle brake of FIG. 1 according to an embodiment of the present invention.
Figure 3:
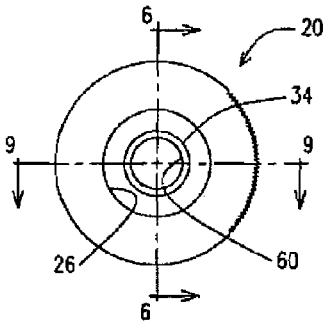
FIG. 3 is a rear end view of the muzzle brake of FIG. 1 according to an embodiment of the present invention.
Figure 4:
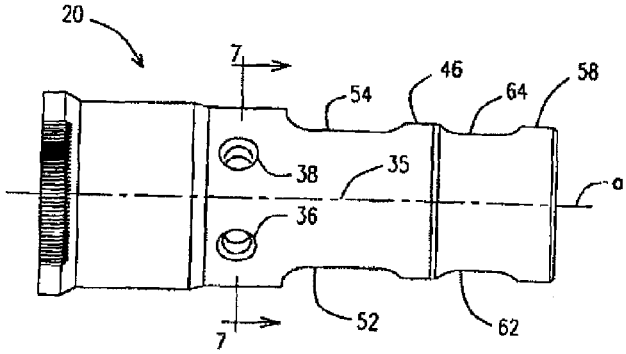
FIG. 4 is a top view of the muzzle brake of FIG. 1 according to an embodiment of the present invention.
Figure 5:
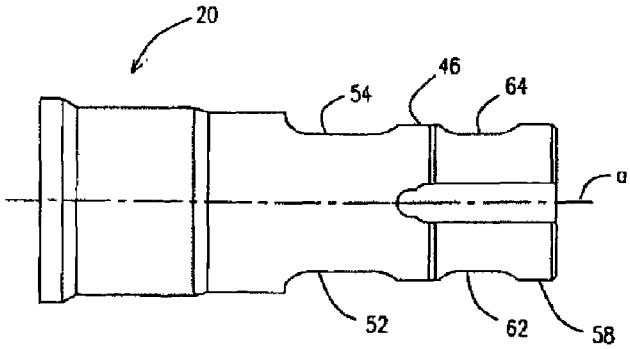
FIG. 5 is a bottom view of the muzzle brake of FIG. 1 according to an embodiment of the present invention.

In the example shown in FIGS. 1, 4 and 7, the pressure chamber 32 includes two ports 36 and 38, each on opposite sides of the longitudinal top 35 of the body 22 and transversely offset therefrom by different distances, as represented in FIG. 4 by the transverse distances from the longitudinal axis a and, in FIG. 7, by the rotational angles α and β from a vertical line intersecting the longitudinal axis a. While gases venting from both ports 36 and 38 counter muzzle lift when the firearm is fired, the greater offset of the right port 36 as compared to the left port 38 (as well as the greater diameter or cross-sectional area of the right port 36) causes the differentially vented gases through the ports to counter right sideward movement of the muzzle when the firearm is fired by a right-hand shooter. To counter left sideward movement for a left-hand shooter, the offset distances or differential cross-sectional area of the ports would be reversed, i.e. the left port 38 offset and/or diameter would be greater than the right port 36 offset and/or diameter.

Figure 10:
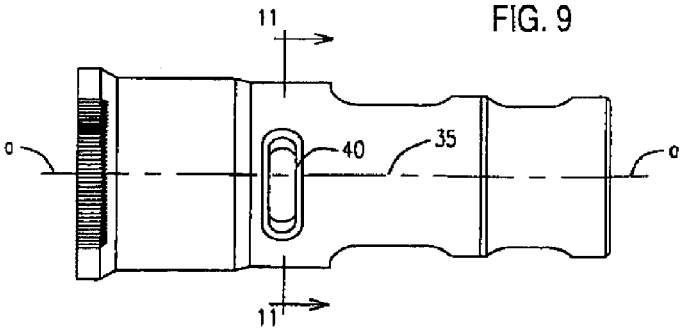
FIG. 10 is a top view of a second embodiment of a muzzle brake according to one or more embodiments of the present invention.
Figure 11:
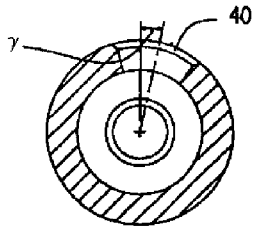
FIG. 11 is a cross-sectional view of the muzzle brake of FIG. 10 according to an embodiment of the present invention, taken along the line 11-11 and viewed in the direction of the appended arrows.

In the muzzle brake example shown in FIGS. 10 and 11, the first chamber 32 includes a port 40 which may be configured as a transverse slot, the port 40 transversely extending along both sides of the top of the body 22, with the center of the port 40 being transversely offset from the top 35 of the body 22. The amount of the offset from the center of the port 40 from a vertical line intersecting the longitudinal axis a (i.e., from the top 35) is indicated in FIG. 11 by the angle .gamma., and the directional flow of the combustion gases exiting through the offset port 40 counters muzzle lift as well as muzzle sideward movement when the firearm is fired by a right-hand shooter. Of course, the direction of the offset of the transverse port 40 would be reversed for a left-hand shooter.

The front portion of the muzzle brake body 22 includes at least one and preferably two further chambers extending along the axial passageway 24 forwardly of the pressure chamber 32. As shown in FIGS. 1, 6 and 9, a second chamber 42 is defined between a transverse rear wall or baffle 44 (which may also comprise the forward wall of the first chamber 32) and a transverse forward wall or baffle 46, the walls 44, 46 preferably being generally orthogonal to the longitudinal axis a. The rear and forward walls 44 and 46 respectively include coaxial bores 34 and 50 of the axial passageway 24 and through which the fired bullet travels.

The second chamber 42 receives combustion gases from the first chamber 32 through the first chamber bore 34, the directions of the gases being represented in FIG. 9 by the direction arrows. Some of these gases continue through the axial bore 50 in the second chamber's forward wall 46, while some of these gases impinge upon the rearwardly facing surface of the forward wall 46 and deflect therefrom, some gases rebounding and forwardly deflecting from the forwardly facing surface of the rear wall 44. The gases impinging upon the rearwardly facing surface of the forward wall 46 provide a forward force to the muzzle brake 20 for countering recoil of the firearm from the firing of the bullet, while much of the gases are laterally vented-outwardly through two opposing side openings 52, 54 extending between the spaced-apart walls 44, 46 of the second chamber 42, one such side opening 52 being through one side of the body 22 and the other such side opening 54 being through the opposite side of the body 22.

The third chamber 56 extends along the axial passageway 24 forwardly of the second chamber 42. The third chamber 56 is defined between a transverse rear wall or baffle which preferably comprises the forward wall 46 of the second chamber 42, and a transverse forward wall or baffle 58, the walls 46, 58 preferably being generally orthogonal to the longitudinal axis a. The third chamber's forward wall 58 includes the axial bore 60 of the axial passageway 24 and through which the fired bullet exits.

The third chamber 56 receives combustion gases from the second chamber 42 through the axial bore 50 in the forward wall 46 of the second chamber 42. Some of these gases continue through the exit bore 60 in the third chamber's forward wall 58, while some of these gases impinge upon the rearwardly facing surface of the forward wall 58 and deflect therefrom, some gases rebounding and generally forwardly deflecting from the forwardly facing surface of the third chamber's rear wall 46. The gases impinging upon the rearwardly facing surface of the forward wall 58 provide a forward force to the muzzle brake 20 for countering recoil of the firearm from the firing of the bullet, while much of the gases are generally laterally vented outwardly through two opposing side openings 62, 64 extending between the spaced-apart walls 46, 58, one such side opening 62 being through one side of the body 22 and the other such side opening 64 being through the opposite side of the body 22.

In accordance with an aspect of the present invention, the forward wall of at least one and preferably both of the second and third chambers 42, 56 are configured along the respective side openings 52, 54 and 62, 64 for eliminating generally rearward deflection from the rearwardly facing surfaces of the forward walls 46, 58 of portions of the gases respectively in the second and third chambers 42, 56.

For example, in the preferred embodiment of the muzzle brake 20, the forward wall 46 of the second chamber 42 is truncated along the respective forward edges of the second chamber's side openings 52 and 54. As specifically illustrated in FIGS. 8 and 9, the truncated edges 48 of the wall 46 may be effected by removing the portions of the peripheral edges or segments 49 (shown in phantom) of the forward wall 46 that would otherwise laterally project from the side openings 52 and 54. The gases which would normally be deflected generally rearwardly (represented in FIG. 9 by the dashed direction arrows) from the portions of the forward wall 46 if not for the truncations would, because of the truncations, be directed generally forwardly (represented by the solid direction arrows through the truncated segments 49) from the side openings 52, 54 of the second chamber 42, thereby reducing concussion at and to the sides of the shooter's position.

Further, in the preferred embodiment of the muzzle brake 20, the forward wall 58 of the third chamber 56 is truncated along the respective forward edges of the third chamber's side openings 62 and 64. As specifically illustrated in FIG. 9 and similarly to the illustration of FIG. 8, the truncated edges 57 of the third chamber's forward wall 58 may be effected by removing the portions of the peripheral edges or segments 59 (shown in phantom) of the forward wall 58 that would otherwise laterally project from the side openings 62 and 64. The gases which would normally be deflected generally rearwardly (represented in FIG. 9 by the dashed direction arrows) from the portions of the forward wall 58 if not for the truncations would, because of the truncations, be directed generally forwardly (represented by the solid directional arrows through the truncated segments 59) from the side openings 62, 64 of the third chamber 56, thereby further reducing concussion at and to the sides of the shooter's position.

According to another aspect of the present invention, at least one and preferably both of the second and third chambers include at least one gas diverting surface between the chamber's rear wall and its forward wall, for influencing the gases vented from the chambers' side openings to be dispersed over a large lower pressure area.

For example, the second chamber 42 may include a floor 66 between the rear wall 44 and the forward wall 46 (i.e., between the side openings 52, 54), the floor 66 being upwardly curved toward the axial passageway 24 (i.e., toward the longitudinal axis a), preferably forming a longitudinally extending apex 67 extending between and approaching the axial bores 44 and 50, as illustrated in FIGS. 1, 6 and 9 and best shown in FIG. 8. The second chamber 42 further includes a ceiling 68 between the second chamber's rear wall 44 and its forward wall 46, the ceiling 68 being downwardly curved toward the axial passageway 24 (i.e., toward the longitudinal axis a), preferably forming a longitudinally extending nadir 69. Although not fully understood, it is believed that turbulence of the gases in the second chamber 42 is increased as the gases engage the concave floor and ceiling surfaces 66, 68 tending to longitudinally divide the second chamber 42, dissipating energy from the gases exiting through the side openings 52, 54.

Similarly, the third chamber 56 may include a floor 70 between the third chamber's rear wall 46 and its forward wall 58, the floor 70 being upwardly curved toward the axial passageway 24, as illustrated in FIGS. 1, 6 and 9 and similarly to the showing in FIG. 8. The third chamber 56 further includes-a ceiling 72 between the third chamber's rear wall 46 and its forward wall 58, the ceiling 72 being downwardly curved toward the axial passageway 24. It is believed that turbulence of the gases in the third chamber 56 is increased as the gases engage the concave floor and ceiling surfaces 70, 72 tending to longitudinally divide the third chamber 56, dissipating energy from the gases exiting through the side openings 62, 64.

Thus, there have been described various embodiments of a muzzle brake for firearms, the muzzle brake including structural features that affect the flow characteristics of the combustion gases for reducing concussion to the shooter and to personnel to the sides of the shooter, as well as for directionally countering upward and sideward movement of the firearm's muzzle upon firing of the firearm. Other embodiments of the present invention, and variations of the embodiments presented herein, may be developed without departing from the essential characteristics thereof. Accordingly, the invention should be limited only by the scope of the claims listed below.

What is claimed is:

1. A device, comprising:

a body having an axial passageway configured to align with a firearm barrel as a muzzle brake;

a first chamber of the body, the first chamber extending along the axial passageway and configured to receive combustion gases from the firearm barrel, wherein the first chamber includes a plurality of ports configured to vent a portion of the combustion gases from the first chamber and counter muzzle lift and sideward movement resulting from the firing of a firearm having the firearm barrel;

a second chamber of the body, the second chamber extending along the axial passageway and configured to receive at least a portion of the combustion gases from the first chamber, wherein the second chamber includes a front wall, a rear wall, a floor, and a ceiling, and wherein the floor, the ceiling, or both the floor and the ceiling have surfaces curved toward the axial passageway to form a corresponding longitudinally extending apex or nadir parallel to the axial passageway; and wherein the second chamber further comprises two opposing side openings in the body to allow at least a first portion of the combustion gases in the second chamber to pass outwardly from the body.

2. The device of claim 1, further comprising a firearm having the firearm barrel, the body coupled to the firearm barrel such that a bullet passes through the firearm barrel and through the axial passageway, including the first chamber and the second chamber, before exiting out an exit bore of the body.

3. The device of claim 1, wherein:

the surface of the floor is upwardly curved toward the axial passageway to form the longitudinally extending apex parallel to the axial passageway; and the surface of the ceiling is downwardly curved toward the axial passageway to form the longitudinally extending nadir parallel to the axial passageway.

4. The device of claim 1, wherein the front wall and the rear wall are disposed orthogonal to and have coaxial bores aligned with the axial passageway, and wherein the front wall is laterally narrower than the rear wall such that at least a second portion of the combustion gases in the second chamber is deflected from the front wall to the rear wall and deflected from the rear wall outwardly and forwardly from the body through the side openings and by the front wall.

5. The device of claim 1, wherein the body is cylindrical.

6. The device of claim 5, wherein the body is cylindrical and has a circular shape in a plane perpendicular to the axial passageway.

7. The device of claim 1, wherein at least one of the plurality of ports has a larger diameter than another one of the plurality of ports.

8. The device of claim 1, wherein at least two of the plurality of ports is connected by a channel.

9. The device of claim 1, further comprising a third chamber of the body, the third chamber extending along the axial passageway and configured to receive at least a portion of the combustion gases from the second chamber, wherein the third chamber includes a front wall, a rear wall, a floor, and a ceiling, and wherein:

the floor of the third chamber is upwardly curved toward the axial passageway to form a longitudinally extending apex parallel to the axial passageway; and the ceiling of the third chamber is downwardly curved toward the axial passageway to form a longitudinally extending nadir parallel to the axial passageway.

10. The device of claim 9, wherein the third chamber further comprises two opposing side openings in the body to allow at least a first portion of the combustion gases in the third chamber to pass outwardly from the body, and wherein the front wall and the rear wall of the third chamber are disposed orthogonal to and have coaxial bores aligned with the axial passageway, and wherein the front wall of the third chamber is laterally narrower than the rear wall of the third chamber such that at least a second portion of the combustion gases in the third chamber is deflected from the front wall to the rear wall and deflected from the rear wall outwardly and forwardly from the body through the side openings and by the front wall of the third chamber.

11. A device, comprising:

a muzzle brake, having a body and an axial passageway, configured to couple to a muzzle of a firearm, the muzzle brake comprising:

a first chamber, disposed within the body and along the axial passageway, configured to receive combustion gases from the muzzle, the first chamber including at least one port configured to vent a first portion of the combustion gases;

a second chamber, disposed within the body and along the axial passageway, configured to receive at least a second portion of the combustion gases from the first chamber, wherein the second chamber includes a front wall, a rear wall, a floor, and a ceiling, wherein the floor includes two gas diverting surfaces that are upwardly curved toward the axial passageway to form a longitudinally extending apex parallel to the axial passageway, and wherein the ceiling includes two gas diverting surfaces downwardly curved toward the axial passageway to form a longitudinally extending nadir parallel to the axial passageway;

wherein the second chamber further comprises two opposing side openings in the body to allow at least a first portion of the combustion gases in the second chamber to pass outwardly from the body;

wherein the front wall and the rear wall are disposed orthogonal to and have coaxial bores aligned with the axial passageway, and wherein the front wall is laterally narrower than the rear wall such that at least a second portion of the combustion gases in the second chamber is deflected from the front wall to the rear wall and deflected from the rear wall outwardly and forwardly from the body through the side openings and by the front wall;

wherein the first chamber includes at least one port adapted to vent a portion of the combustion gases from the first chamber, and wherein the body further comprises:

a third chamber, disposed within the body and along the axial passageway, configured to receive at least a portion of the combustion gases from the second chamber, wherein the third chamber includes a front wall, a rear wall, a floor, and a ceiling, and wherein:

the floor of the third chamber includes two gas diverting surfaces that are upwardly curved toward the axial passageway to form a longitudinally extending apex parallel to the axial passageway; and the ceiling of the third chamber includes two gas diverting surfaces that are downwardly curved toward the axial passageway to form a longitudinally extending nadir parallel to the axial passageway.

12. The device of claim 11, wherein the body is cylindrical and has a circular shape in a plane perpendicular to the axial passageway.

13. The device of claim 11, further comprising the firearm, the body coupled to the muzzle of the firearm such that a bullet passes through the muzzle and through the axial passageway, including the first chamber and the second chamber, before exiting out an exit bore of the body.

14. A method, comprising:

aligning the body of claim 1 to the firearm barrel of a firearm; and coupling the body to the firearm barrel, wherein the surfaces form gas diverting surfaces for combustion gases in the event that the firearm is fired.

15. The method of claim 14, wherein the aligning comprises placing the axial passageway of the body adjacent and forwardly to the firearm barrel to align the body to a longitudinal axis of the firearm barrel, and wherein the coupling comprises threading the body onto the firearm barrel.

* * * * *